US009590310B1

(12) United States Patent
Barts et al.

(10) Patent No.: US 9,590,310 B1
(45) Date of Patent: Mar. 7, 2017

(54) SHAPED ANTENNA OF PLANAR CONDUCTING MATERIAL

(71) Applicant: Greenwave Scientific, Inc., Raleigh, NC (US)

(72) Inventors: Robert Michael Barts, Raleigh, NC (US); Peter Marcus Buff, Garner, NC (US)

(73) Assignee: GREENWAVE SCIENTIFIC, INC., Raleigh, NC (US)

( * ) Notice: Subject to any disclaimer, the term of this patent is extended or adjusted under 35 U.S.C. 154(b) by 347 days.

(21) Appl. No.: 14/017,343

(22) Filed: Sep. 4, 2013

Related U.S. Application Data

(60) Provisional application No. 61/777,325, filed on Mar. 12, 2013.

(51) Int. Cl.

| | |
|---|---|
| ***H01Q 1/38*** | (2006.01) |
| ***H01Q 9/28*** | (2006.01) |
| ***H01Q 1/36*** | (2006.01) |
| ***H01Q 5/371*** | (2015.01) |

(52) U.S. Cl.
CPC ..... *H01Q 9/285* (2013.01); *H01Q 1/36* (2013.01); *H01Q 1/38* (2013.01); *H01Q 5/371* (2015.01); *H01Q 9/28* (2013.01)

(58) Field of Classification Search
CPC ..... H01Q 9/285; H01Q 9/28; H01Q 1/38
USPC ..... 343/795
See application file for complete search history.

(56) References Cited

U.S. PATENT DOCUMENTS

| | | | | |
|---|---|---|---|---|
| 5,872,546 | A * | 2/1999 | Ihara | H01Q 9/28 343/795 |
| 7,471,256 | B2 * | 12/2008 | Kwon | H01Q 9/28 343/795 |
| 8,659,483 | B2 * | 2/2014 | Ridgeway | H01Q 9/285 343/700 MS |
| 2004/0100407 | A1 * | 5/2004 | Okado | H01Q 1/38 343/700 MS |
| 2004/0217912 | A1 * | 11/2004 | Mohammadian | H01Q 1/38 343/795 |
| 2006/0017643 | A1 * | 1/2006 | Shimasaki | H01Q 1/38 343/795 |
| 2009/0256767 | A1 * | 10/2009 | Kan | H01Q 1/2258 343/795 |
| 2009/0295670 | A1 * | 12/2009 | Tsai | H01Q 1/38 343/850 |
| 2012/0162021 | A1 * | 6/2012 | Lee | H01Q 21/26 343/700 MS |
| 2012/0229342 | A1 * | 9/2012 | Maeda | H01Q 1/36 343/700 MS |
| 2013/0314290 | A1 * | 11/2013 | Liu | H01Q 9/285 343/795 |

* cited by examiner

*Primary Examiner* — Dameon E Levi
*Assistant Examiner* — AB Salam Alkassim, Jr.
(74) *Attorney, Agent, or Firm* — Tillman Wright, PLLC; James D. Wright; Neal B. Wolgin

(57) ABSTRACT

Typical consumer-grade terrestrial television antennas use simple flat plates in a dipole configuration. Reception is enhanced by elevating the antenna for better line of sight to the broadcast antenna, which often necessitates locating the antenna in the attic of a building or on the roof in the where it is exposed to the weather. The antenna disclosed is uses antenna elements that are substantially planar, have a unique shape that improves reception, and allows for compact packaging in a weatherproof case.

13 Claims, 3 Drawing Sheets

SHAPED ANTENNA OF PLANAR CONDUCTING MATERIAL

CROSS-REFERENCE TO RELATED APPLICATION

The present application is a U.S. nonprovisional patent application of, and claims priority under 35 U.S.C. §119(e) to, U.S. provisional patent application Ser. No. 61/777,325, filed Mar. 12, 2013, which provisional patent application is incorporated by reference herein.

COPYRIGHT STATEMENT

All of the material in this patent document is subject to copyright protection under the copyright laws of the United States and of other countries. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

Field of the Invention

The present invention relates generally to antennas and methods for making the same, and in particular to an antenna that can operate over a wide range of frequencies and frequency bands. Typical applications include, but are not limited to, cellular networks, data networks, and terrestrial television broadcast reception. The capability to operate over a large bandwidth range with good performance is a benefit for any communication application that operates over numerous channels or over multiple frequency bands.

Broad bandwidth antennas have the desirable characteristics of relatively constant impedance or low voltage standing wave ratio (VSWR) across their operating bandwidth. Additionally, minimal variation in antenna radiation pattern and gain across the operating bandwidth are also desirable for broad bandwidth antennas. Achieving those goals over an octave or more of frequency range is a non-trivial performance objective. In some instances sophisticated feed networks can be utilized to improve VSWR bandwidth, but often at the expense of radiation efficiency and complexity. Radiation pattern stability across a frequency band is primarily a function of antenna size and shape, as is efficiency and gain. True broadband antenna performance is best realized through careful design of the antenna shape and structure to provide inherent broadband characteristics.

Therefore, a need exists for improvement in the field of antennas that are efficient, are relatively inexpensive and simple to manufacture, and that offer good impedance and gain performance over a wide bandwidth range.

Description of the Prior Art

Consumer use of cable or satellite providers for broadband services such as television and internet service has become ubiquitous in many homes, offices, and commercial environments. However, there remain a large number of consumers that prefer to avoid the expenses of a cable or satellite subscription and opt to receive terrestrial television broadcasts. After the switch by broadcasters from analog terrestrial broadcasts to digital terrestrial broadcasts, consumers that chose to avoid cable and satellite services required new terrestrial television antennas to receive digital signals as the as the majority of terrestrial television broadcast stations have moved their broadcasts from the VHF band to the UHF band. The majority of television receiver manufacturers no longer sell receivers with antennas, and many sell receivers that are in fact simply monitors without internal tuners or antennas. This has created a new consumer need for modern antennas that can receive the broadband signals now used that are transmitted under the Advanced Television Standard Committee (ATSC) terrestrial television broadcast standard.

There are prior art antennas that exist for this purpose, but many such antennas are made for indoor use only, or operate only marginally performance-wise across the entire ATSC spectrum.

The prior art devices are aesthetically unpleasing, flimsy, expensive, or difficult to use. Therefore, there exists a need for an antenna that is aesthetically pleasing, rugged, weatherproof, less expensive, and easy to install and adjust, that also provides superior performance.

BRIEF DESCRIPTION OF THE DRAWINGS

One or more preferred embodiments of the present invention will now be described in detail with reference to the accompanying drawings, wherein the same elements are referred to with the same reference numerals.

DETAILED DESCRIPTION

Figure 1:
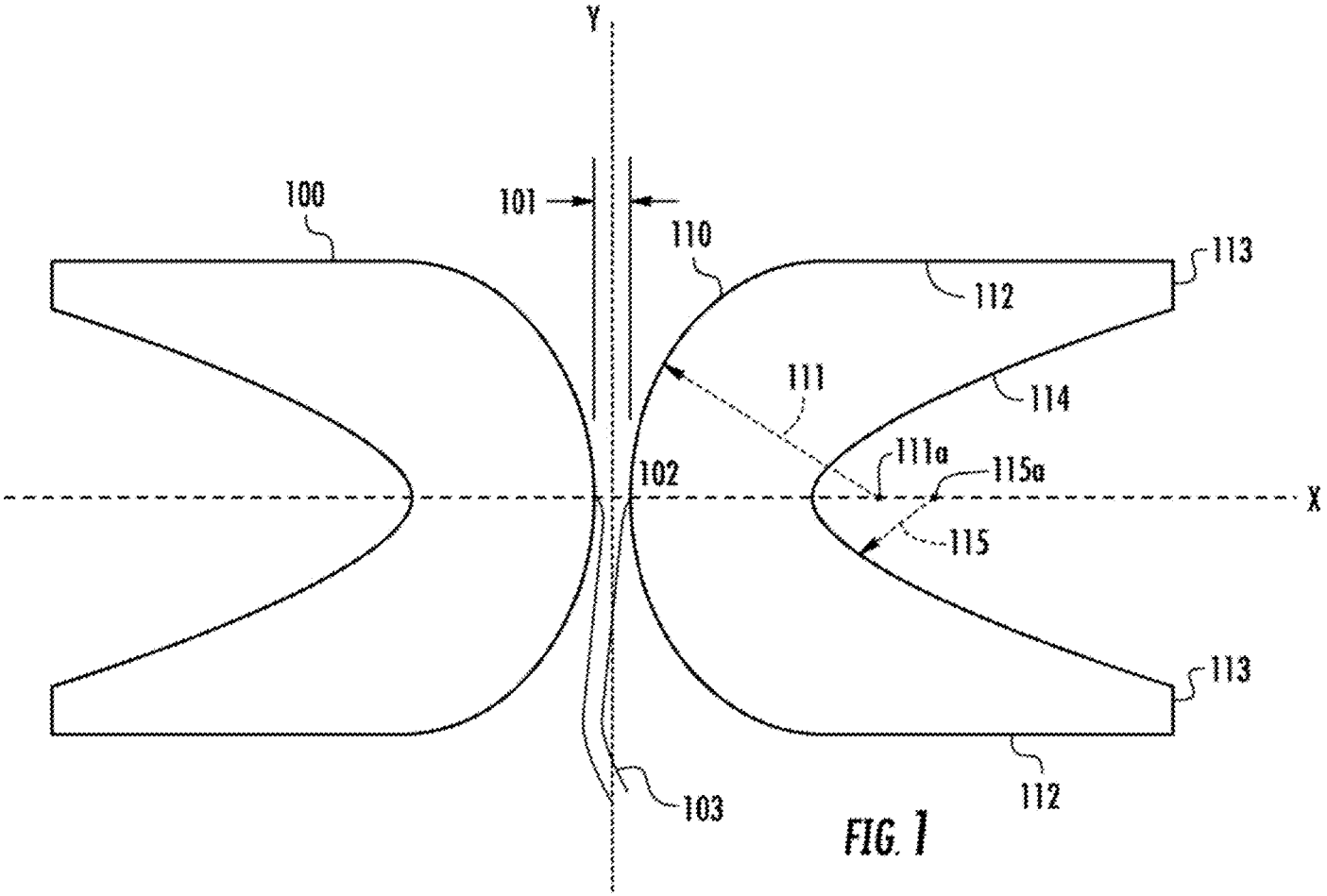
FIG. 1 illustrates the receiving elements and feed location of the antenna of the present invention.

As a preliminary matter, it will readily be understood by one having ordinary skill in the relevant art (an "Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended to, nor is to be construed to, limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein, as understood by the Ordinary Artisan based on the contextual use of such term, differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "an antenna having an attached cable" describes "an antenna having at least one cable" as well as "an antenna having cables." In contrast, reference to "an antenna having a single cable" describes "an antenna having only one cable".

When used herein to join a list of items, "or" denotes "at least one of the items," but does not exclude a plurality of items of the list. Thus, reference to "an antenna that has an amplifier or a cable" describes "an antenna that has an amplifier without a cable", "an antenna having a cable without an amplifier", and "an antenna having both an amplifier and a cable". Finally, when used herein to join a list of items, "and" denotes "all of the items of the list." Thus, reference to "an antenna having an amplifier and an attached cable" describes "an antenna having an amplifier, wherein the amplifier further has an attached cable," as well as describes "an antenna having a cable, wherein the cable further has an attached amplifier".

Referring now to the drawings, one or more preferred embodiments of the present invention are next described. The following description of one or more preferred embodiments is merely exemplary in nature and is in no way intended to limit the invention, its implementations, or uses.

The invention disclosed herein describes an antenna, and in particular the antenna elements of such an antenna, that has improved performance characteristics. In one embodiment of the present invention, the antenna elements are formed from a planar sheet of electrically conductive material in a manner and have a unique shape that enhances reception over a wide frequency range with good impedance matching over a 4:1 bandwidth range with moderate gain and essentially omni-directional performance in a compact physical size. An antenna employing the antenna element of the present invention may further comprise packaging that is constructed from electrically non-conductive material such as polycarbonate or other suitable materials. The antenna pattern in azimuth is comparable to that of a dipole antenna, but with higher gain. In applications involving point-to-multipoint communications or broadcast reception from multiple sources, a broad beamwidth antenna pattern is desirable in order to avoid the need for accurate antenna pointing.

In another embodiment of the invention, the antenna is designed for reception of over-the-air (OTA) television signals. The American television spectrum covers the 54-700 MHz frequency range, which includes some allocations for other uses, and is split between low VHF (54-88 MHz), high VHF (174-216 MHz), and UHF (470-700 MHz). Since the conversion from NTSC analog to ATSC digital terrestrial broadcast signals, the lower VHF segment is lightly used, but the high VHF frequency range is still utilized. The frequency range from 174-700 MHz is approximately a 4:1 range. An embodiment of the invention constructed from a conductive material such as metallic plates or metal foil or a thin metallic film can cover this frequency range with low VSWR and consistent radiation patterns and gain. The input impedance of this embodiment can be adjusted by modifying the design parameters to accommodate an input impedance that is compatible with common coaxial cables used to connect television antennas and television tuners.

Figure 2A:
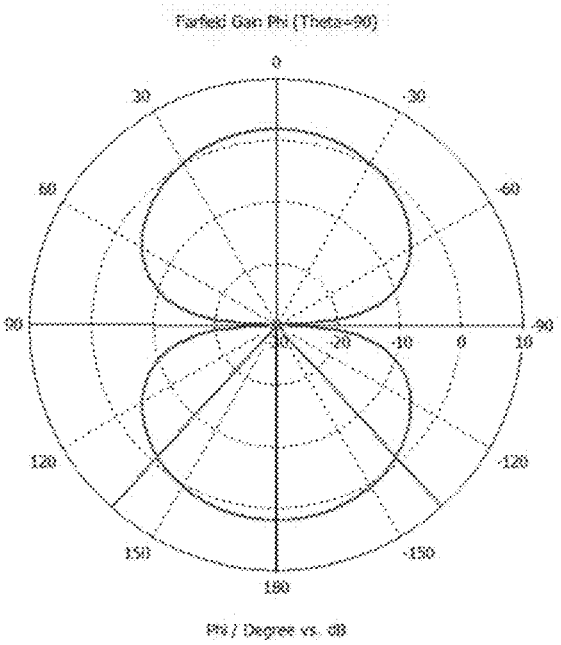
FIGS. 2*a-b* illustrate gain plots of the antenna of the present invention.
Figure 2B:
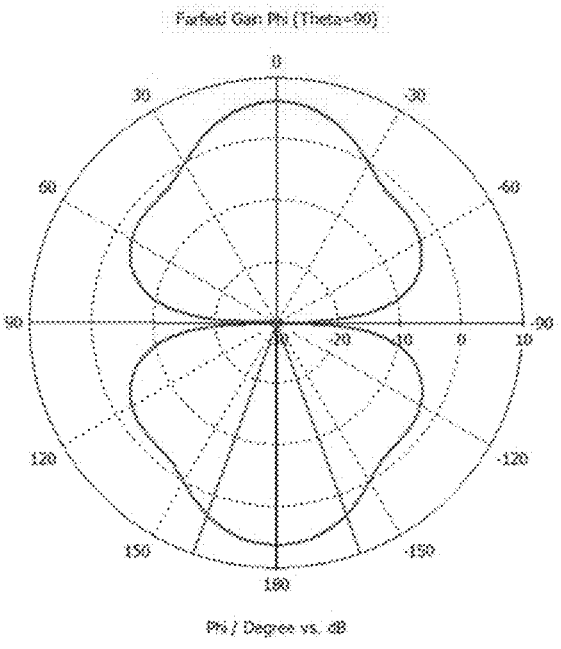
Figure 3:
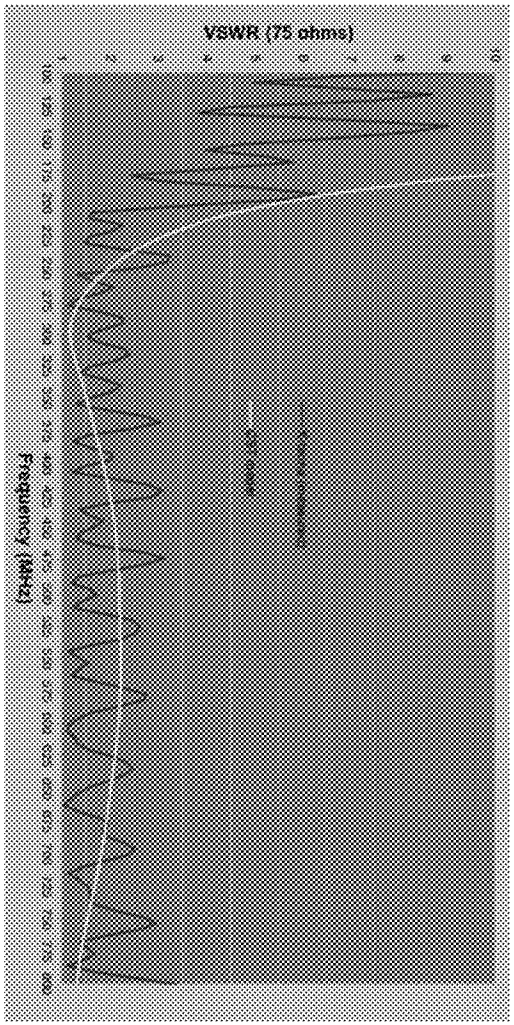
FIG. 3 illustrates the voltage standing wave ratio measurement of the antenna of the present invention.

FIG. 1 illustrates the receiving elements and feed location of the antenna of the present invention, FIGS. 2*a-b* illustrate gain plots of the antenna of the present invention, and FIG. 3 illustrates the voltage standing wave ratio measurement of the antenna of the present invention.

The antenna of the present invention is a planar antenna that provides good impedance matching over a 4:1 bandwidth with moderate gain and essentially omni-directional performance in a compact physical size. The planar antenna elements may be metallic plates, metal foil, a thin metallic film, or other conductive materials. An antenna constructed using the antenna elements of the present invention may exhibit an antenna pattern in azimuth that is comparable to that of a dipole antenna, but with higher gain. In applications involving point-to-multipoint communications or broadcast reception from multiple sources, a broad beamwidth antenna pattern is desirable in order to avoid the need for accurate pointing of the antenna to maximize performance.

The antenna elements of the present invention consists of two planar conducting elements 100, both elements being in a common plane positioned as mirror images of each other, as shown in FIG. 1. The shape of each single element 100 is described by an outer central curved edge 110 of radius 111 formed around axis 1*a*. The outer curved edge 110 blends into a substantially straight linear edge 112, which terminates at a truncated edge 113 at the outside end of each element 100. Each single element 100 is further described by an inner curved edge 114 of parabolic shape 115 formed around parabola focus 115*a*. The inner curved edge 114 terminates at a truncated edge 113 at the outside end of each element 100 in a manner identical to linear edge 112. The inner curved edge 114 may be substantially parabolic in shape, but need not be so. If the inner curved edge 114 is parabolic, the directrix of this parabola is a plane that runs through the center of gap 101, or the—y-axis. Axis 111*a* and parabola focus 115*a* are aligned along a plane that runs down the center of each element 100. Axis 111*a* may be coincident with parabola focus 115*a*, but does not have to be so. The inner curved edge 114 does not have to be parabolic, but can also be elliptical, circular or a series of free-style spline curves. The antenna elements are electrically connected by transmission line 103 which is connected to each of the elements 100, which can then be terminated in a cable connector such as an F-connector for a co-axial cable (not shown).

The performance of an antenna constructed of the antenna elements of the present invention is dependent on the dimensions of the several different segments of elements 100. The most critical dimension of the several different segments is the radius 111, the next most critical dimension is the length of the substantially straight linear edge 112, and the next most critical dimension is the parameters that define the inner curved edge 114 (such as parabola focus 115*a* and the distance to the directrix). The radius 111 and the length of substantially straight linear edge 112 are the dominant parameters that determine the frequency response of the antenna of the present invention.

One of the common trade-offs in antenna design is the overall size of the antenna assembly and the overall packaged shape. One of the design goals of an antenna comprising the antenna elements of the present invention is that the antenna must have a reasonably compact size and a pleasing aesthetic shape. Radius 111 may be any reasonable length, but for the frequency range disclosed herein, a value of 100 mm provides optimal performance. Linear edge 112 may also be any reasonable length, but for the frequency range disclosed, an optimal value in the range of 130 to 150 mm. In the embodiment where inner curved edge 114 is parabolic in shape, a focus 115*a* of 25 to 40 mm is optimal if the directrix of inner curved edge 114 is located along the y-axis as shown in FIG. 1.

In a preferred embodiment of an antenna comprising the disclosed antenna elements, a pair of antenna elements 100 is positioned in a mirror image fashion in a common plane and along a common axis such that the outer edges of outer curved edges 110 would touch tangentially but for the separation of gap 101. The two elements 100 are separated symmetrically. The feedpoint impedance of an antenna comprising the antenna elements of the present invention is influenced by the width of gap 101 between the two elements 100. The optimal feedpoint 102 of the antenna elements is located at the point of closest spacing between the two elements 100, which occurs along the—x-axis. Variation of the width of gap 101 can change the feedpoint impedance of the antenna within a nominal range for optimization. In the instance where a 75 ohm coaxial cable will be used to connect the antenna to a television tuner, a feedpoint gap 101 of 6 to 7 mm is optimal. Offsetting the feedpoint from the optimal feedpoint 102 will also vary the feedpoint impedance.

An antenna comprising the antenna elements of the present invention, when positioned and connected to a transmission line 103 as shown in FIG. 1, will produce horizontal polarization. Typical antenna patterns for the antenna of the present invention are shown in FIGS. 2*a-b*. These figures show the azimuth antenna patterns where the elements are aligned along the horizontal axis and laying in the plane perpendicular to the page.

One of the features of an antenna comprising antenna elements of the present invention is the wide bandwidth response. FIG. 3 illustrates the voltage standing wave ratio (VSWR) values for one embodiment of such as antenna, including results from computer simulations and measurements of an actual antenna for comparison. Depending on the VSWR criteria used, the impedance bandwidth is at least 4:1, and may be as good as 6:1.

The antenna elements of the present invention can be made from any conducting material, including but not limited to metal plates, metal foil, or thin metallic film. While one embodiment is described as being planar, the elements may be curved in either plane into non-planar shapes to a certain extent without substantially affecting the performance of an antenna comprising the disclosed antenna elements. Curvature beyond a certain point will however result in deterioration of the antenna pattern and impedance, thereby adversely affecting overall performance.

What is claimed is:

1. An antenna element wherein said element is comprised of a planar conducting material, wherein the shape of said element has:

an outer central curved edge with a radius centered on a central axis, and said curved edge blending into a substantially linear edge, which such substantially linear edge is truncated by a straight edge substantially perpendicular to said substantially linear edge;

an inner curved edge that is substantially parabolic in shape with its axis aligned with the central axis of said outer curved edge, which such substantially parabolic inner curved edge is truncated along a common edge as the outer central curved edge; and wherein said outer curved edge has a radius of between 80 and 120 mm and said substantially linear edge is between 130 and 150 mm in length.

2. The antenna element of claim 1 wherein said outer curved edge has a radius of 100 mm.

3. The antenna element of claim 1 wherein said substantially linear edge is 140 mm in length.

4. The antenna element of claim 1 wherein said inner curved edge has a focus of between 25 and 40 mm.

5. The antenna element of claim 1 wherein said outer curved edge has a radius of between 80 and 120 mm, said substantially linear edge is between 130 and 150 mm in length, said inner curved edge has a focus of between 25 and 40 mm, and said truncated straight edge is between 20 and 40 mm in length.

6. The antenna element of claim 5 wherein said outer curved edge has a radius of 100 mm, said substantially linear edge is 140 mm in length, said inner curved edge has a focus of 37 mm, and said truncated straight edge is 30 mm in length.

7. An antenna comprising two identical antenna elements that are arranged in a planar manner and in a mirrored configuration, wherein each of said identical antenna elements comprise a planar conducting material, wherein the shape of each said element has:

an outer central curved edge with a radius centered on a central axis, and said curved edge blending into a substantially linear edge, which such substantially linear edge is truncated by a straight edge substantially perpendicular to said substantially linear edge; and an inner curved edge that is substantially parabolic in shape with its axis aligned with the central axis of said outer curved edge, which such substantially parabolic inner curved edge is truncated along a common edge as the outer central curved edge; and wherein said outer curved edge has a radius of between 80 and 120 mm, said substantially linear edge is between 130 and 150 mm in length.

8. The antenna of claim 7 wherein said inner curved edge has a focus of between 25 and 40 mm, and said truncated straight edge is between 20 and 40 mm in length.

9. The antenna of claim 8 wherein the outer curved edges of each of the antenna elements are in close proximity to each other.

10. The antenna of claim 9 wherein the feedpoint of said antenna is at the point where the outer curved edges are in closest proximity.

11. The antenna of claim 8 wherein the distance between said outer curved edges of each of the antenna elements is between 6 and 7 mm.

12. An antenna comprising two identical antenna elements that are arranged in a planar manner and in a mirrored configuration, wherein each of said identical antenna elements comprise a planar conducting material, wherein the shape of each said element has:

an outer central curved edge with a radius centered on a central axis, and said curved edge blending into a substantially linear edge, which such substantially linear edge is truncated by a straight edge substantially perpendicular to said substantially linear edge; and an inner curved edge that is substantially parabolic in shape with its axis aligned with the central axis of said outer curved edge, which such substantially parabolic inner curved edge is truncated along a common edge as the outer central curved edge; and wherein said outer curved edge has a radius of between 80 and 120 mm, said substantially linear edge is between 130 and 150 mm in length, said inner curved edge has a focus of between 25 and 40 mm, and said truncated straight edge is between 20 and 40 mm in length.

13. The antenna of claim 12 wherein the outer curved edges of each of the antenna elements are in close proximity to each other, the feedpoint of said antenna is at the point where the outer curved edges are in closest proximity, and wherein the distance between said outer curved edges of each of the antenna elements is between 6 and 7 mm.

* * * * *